US008270642B2

(12) United States Patent
Kuhn et al.

(10) Patent No.: US 8,270,642 B2
(45) Date of Patent: Sep. 18, 2012

(54) METHOD AND SYSTEM FOR PRODUCING A BINAURAL IMPRESSION USING LOUDSPEAKERS

(75) Inventors: Clemens Kuhn, Zurich (CH); Renato Pellegrini, Niederhasli (CH); Matthias Rosenthal, Dielsdorf (CH); Etienne Corteel, Paris (FR)

(73) Assignee: SonicEmotion AG, Oberglatt (CH)

( * ) Notice: Subject to any disclaimer, the term of this patent is extended or adjusted under 35 U.S.C. 154(b) by 1496 days.

(21) Appl. No.: 11/798,478

(22) Filed: May 14, 2007

(65) Prior Publication Data

US 2008/0025534 A1 Jan. 31, 2008

(30) Foreign Application Priority Data

May 17, 2006 (EP) ..... 06010125

(51) Int. Cl.
*H04R 5/02* (2006.01)
*H04R 5/00* (2006.01)

(52) U.S. Cl. ..... 381/310; 381/17; 381/18; 381/19; 381/300; 381/303

(58) Field of Classification Search ..... 381/17–19, 381/300, 309–310, 303
See application file for complete search history.

(56) References Cited

U.S. PATENT DOCUMENTS 5,136,651 A 8/1992 Cooper et al.
5,579,396 A 11/1996 Iida et al.
5,687,239 A 11/1997 Inanaga et al.
5,862,227 A 1/1999 Orduna-Bustamante et al.
6,760,447 B1 7/2004 Nelson et al.
2005/0053249 A1* 3/2005 Wu et al. ..... 381/310

* cited by examiner

*Primary Examiner* — Yuwen Pan
*Assistant Examiner* — George Monikang
(74) *Attorney, Agent, or Firm* — Buchanan Ingersoll & Rooney PC

(57) ABSTRACT

The invention relates to a method and device for reproducing sound from a first input audio signal (1) using a plurality of first loudspeakers (4) and producing a target binaural impression to a listener (6) within a listening area (55). In order to decrease the sensibility of the reproduction of sound to the environment acoustics and to simplify the adaptation of the reproduced sound to the listener's head orientation and position, it is proposed to first define a plurality of second virtual loudspeakers (49) positioned outside of the listening area (55), then to estimate a transfer function (17) between each second virtual loudspeaker (49) and the listener's ears (7*a* and 7*b*), to compute from the estimated transfer functions (17) transaural filters (2) that modify the said first input audio signal (1) to synthesize second audio input signals (30) and to synthesize input signals (3) from second audio input signals (30) for creating a synthesized wave field (34) by the said first loudspeakers (4) that appears, within the listening area (55), to be emitted by the plurality of second virtual loudspeakers (49) as a plurality of wave fronts (50) in order to reproduce the target binaural impression at the ears of the listener (7*a* and 7*b*).

10 Claims, 6 Drawing Sheets

METHOD AND SYSTEM FOR PRODUCING A BINAURAL IMPRESSION USING LOUDSPEAKERS

The invention relates to a method and a device for producing sound from a first input audio signal using a plurality of first loudspeakers and producing a target binaural impression to a listener within a listening area.

The reproduction of a specific binaural impression to a listener using loudspeakers is usually referred to as transaural sound reproduction. For such technique, recorded or synthesized binaural signals are generally used as input signals. The binaural impression they convey is to be transmitted directly at the ears of a human listener. This may be simply achieved by using headphones. However, in loudspeaker-based reproduction, signals emitted by each loudspeaker are transmitted to both ears of the listener. This general problem is referred to as crosstalk. Cancellation of crosstalk is thus one of the main objectives of transaural sound reproduction. It may allow one to transmit one of the binaural signals directly to the dedicated ear of the listener as described in U.S. Pat. No. 3,236,949.

Crosstalk cancellation is made possible by the fact that the signal emitted by a given loudspeaker is perceived differently at both ears. This is due to the ears' physical separation (propagation delay) and the shadowing of the head that modifies the spectral content of the contralateral ear compared to the ipsilateral ear. This relates to so-called HRTFs (Head-Related Transfer Functions) that describe such modification for a given position (angle, possibly distance) of the incoming source. They provide cues to the auditory system that are used to localize a sound event at a given position in space as described by J. Blauert in "Spatial Hearing, the psychophysics of human sound interaction", MIT Press, 1999.

FIG. 1 is a description of a general case of crosstalk cancellation according to the state of the art. The goal of the presented system is to transmit the input signal 1 directly to the left ear 7*a* of the listener 6. Two loudspeakers 4*a* and 4*b* are employed. Transaural filtering 2*a* and 2*b* of input signal 1 creates loudspeakers' driving signals 3*a* and 3*b*. Transaural filters are designed such that:

- the combination of the signal emitted by the left loudspeaker 4*a* to the left ear 7*a* of the listener and the signal emitted by the right loudspeaker 4*b* to the left ear 7*a* of the listener equals the input signal 1;
- the signal emitted by the left loudspeaker 4*a* to the right ear 7*b* of the listener 6 and the signal emitted by the right loudspeaker 4*b* to the right ear 7*b* of the listener 6 cancel each other.

In this basic form of crosstalk canceller, the left loudspeaker 4*a* is dedicated to the delivery of the input signal 1 to the left ear 7*a* whereas the right loudspeaker 4*b* is meant for the cancellation of the crosstalk path of the left loudspeaker 4*a* to the right ear 7*b*.

The loudspeaker/listener system can be described as Multi-input Multi-Output (MIMO) system by measuring or modelling the transfer functions $C_{i,j}(z)$ from loudspeaker i to ear j of the listener. Measured transfer functions can be arranged in a matrix C(z) of the following form:

$$C(z) = \begin{bmatrix} C_{a,a}(z) & C_{a,b}(z) \\ C_{b,a}(z) & C_{b,b}(z) \end{bmatrix}$$

Filters $H_i(z)$ can be inserted to modify the loudspeakers driving signals. For convenience, they are arranged in a matrix:

$$H(z) = \begin{bmatrix} H_a(z) \\ H_b(z) \end{bmatrix}$$

Desired outputs signals $d_j(z)$ at ear j are arranged in a matrix:

$$d(z) = \begin{bmatrix} d_a(z) \\ d_b(z) \end{bmatrix}$$

Therefore, filters H(z) may be designed to synthesize desired signals d(z) at the ears of the listener as:

$$H(z)=C^{-1}(z)d(z)$$

Therefore, transaural filters $H^{CT,1}$ and $H^{CT,2}$ that target crosstalk cancellation for ear a and ear b can be designed by considering:

$$d_{CT,a}(z) = \begin{bmatrix} 1 \\ 0 \end{bmatrix}$$

$$d_{CT,b}(z) = \begin{bmatrix} 0 \\ 1 \end{bmatrix}$$

It may also be possible to synthesize filters that would target another binaural impression. They may, for example, provide the listener with binaural signals that target the localization of a virtual sound source at a given position in space other than the position of the real loudspeakers as described in U.S. Pat. No. 5,799,094. In that case, desired ear signals d(z) are HRTFs corresponding to the desired virtual source position.

Sensitivity of transaural reproduction to listener's movements in the listening area is a serious drawback in known solutions. It is described in the case of crosstalk cancellation by T. Takeuchi, P. A. Nelson, and H. Hamada in "Robustness to head misalignment of virtual sound imaging systems", J. Acoust. Soc. Am. 109 (3), March 2001. These are due to modifications of the acoustical paths 5 from each loudspeaker 4 to the ears 7 of the listener 6. For example, if the listener gets closer to loudspeaker 4*a*, its contributions arrive earlier and with a higher level than those of loudspeaker 4*b*. Therefore, the crosstalk cancellation is reduced because contributions from loudspeakers 4*a* and 4*b* don't cancel each other anymore at listener's right ear 7*b* since they are no longer out of phase nor at similar level.

Other possible causes of crosstalk cancellation limitations are due to modifications of the apparent angular position of the loudspeakers toward the listener's head. It is well known that HRTFs are subject to modifications for different position (angle, distance) of the sound source that radiates the incoming sound field. The latter depends on the local curvature of the sound field.

Known solutions to reduce the sensibility of crosstalk cancellation to head movements consists in using closely spaced (10-20 degrees) loudspeakers usually referred to as "stereo dipole" as described by O. Kirkeby, P. A. Nelson, and H. Hamada in "Local sound field reproduction using two closely spaced Loudspeakers", J. Acoust. Soc. Am. 104 (4), October 1998. This loudspeaker arrangement increases the robustness of the crosstalk canceller to small lateral movements of the listener compared to wider angles (ex: 60 degrees). This configuration particularly minimizes the temporal modifications of both loudspeakers' contributions to head movements.

The known limitation of this configuration is the design of an efficient crosstalk canceller at low frequencies (typically, below 300/400 Hz), which appears as an ill-conditioned problem. The obtained filters have large levels at these low frequencies. This possibly limits the dynamic of the system and may damage the loudspeakers as described by Takashi Takeuchi, Philip A. Nelson in "Optimal source distribution for binaural synthesis over loudspeakers", Acoustics Research Letters Online 2(1), January 2001. A possible solution consists in splitting the rendering of the audio signal into frequency bands. Low frequencies are reproduced using widely spaced loudspeakers (typically 60 degrees spacing) whereas higher frequencies are synthesized using closely spaced loudspeakers (typically 10-20 degrees). This solution is based on the fact that the conditioning of the matrix to be inverted in the crosstalk filter design problem is better for wider loudspeaker arrangements than it is for closely spaced loudspeakers. Moreover, crosstalk cancellation is less sensible to temporal changes due to head movements of loudspeakers' contributions at low frequencies than it is at higher frequencies. A solution using a two way approach is proposed in U.S. Pat. No. 6,633,648. A more general approach is provided in U.S. Pat. No. 6,950,524.

The stereo dipole configuration has also the advantage that the crosstalk canceller is relatively insensible to front-back head movements if the listener is relatively far from the loudspeakers. The relative level, time of arrival, and angular position of both loudspeakers are fairly similar during this type of movement of the listener.

However, this is the case neither for widely spaced loudspeakers, nor for lateral movements, nor in the case when the listener is close to the loudspeakers where the relative angle of the loudspeakers varies more significantly. However, the latter is a known preferred situation to avoid that the acoustics of the listening environment may degrade the performance of the crosstalk canceller. Such results are presented by T. Takeuchi, P. A. Nelson, O. Kirkeby and H. Hamada in "The Effects of Reflections on the Performance of Virtual Acoustic Imaging Systems", pages 955-966, Proceedings of the Active 97, Budapest, Hungary, Aug. 21-23, (1997).

Rotation movements of the head of the listener have not been considered yet. However, they severely degrade the crosstalk cancellation efficiency as described by Takashi Takeuchi, Philip A. Nelson, and Hareo Hamada, in "Robustness to head misalignment of virtual sound imaging systems", J. Acoust. Soc. Am. 109 (3), March 2001. Known solutions consist in tracking listeners' movements and update crosstalk filters accordingly as described in U.S. Pat. No. 6,243,476.

Crosstalk cancellation filters should then be calculated considering several orientations, and also locations of the listener's head and stored in a database. The filters should then be dynamically loaded depending on listener's head location/orientation to achieve sensible crosstalk-cancellation. The main drawback of this approach is the high number of filters to be calculated and stored if one has to account for any location of a listening area.

In most of prior art, only two physical loudspeakers, at least in a given frequency band, are used simultaneously to achieve crosstalk cancellation for a given input signal. Only in a few cases, more loudspeakers are used. There are different goals to these approaches such as:

- achieve crosstalk cancellation at a number of definite locations as described in WO9812896,
- transmit different binaural impressions for various listeners at known places as described in WO9812896,
- reduce the sensitivity of crosstalk cancellation to lateral movements of the listener as described by Mingsian R. Bai, Chih-Wei Tung, and Chih-Chung Lee in "Optimal design of loudspeaker arrays for robust cross-talk cancellation using the Taguchi method and the genetic algorithm", J. Acoust. Soc. Am. 117 (5), May 2005.

The problem is simply expended to P loudspeakers and Q/2 head positions, leading to Q ear signals. Measured transfer functions are arranged in an extended matrix C(z) of the following form:

$$C(z)=\begin{bmatrix} C_{1,1}(z) & \dots & C_{P,1}(z) \\ \vdots & \ddots & \vdots \\ \vdots & \ddots & \vdots \\ C_{1,Q}(z) & \dots & C_{P,Q}(z) \end{bmatrix}$$

Filters H(z) may be designed to synthesize extended desired signals d(z) at the ears of the listener as:

$$H(z)=C^{-1}(z)d(z)$$

In all cases the higher number of loudspeakers is considered as additional degrees of freedom for the design of the crosstalk canceller filters.

A first aim of the proposed invention is to decrease the sensibility of the reproduction of sound to the environment acoustics. It is another aim of the invention to simplify the adaptation of the reproduced sound to the listener's head orientation and position.

The invention consists in synthesizing a wave field as emanating from remote virtual loudspeakers and to use the virtual loudspeakers as acoustical sources for transaural reproduction, the remote virtual loudspeakers being synthesized using a plurality of real loudspeakers and filtering and synthesis devices, whereas the real loudspeakers are closer to the listening area than the virtual loudspeakers. The invention therefore combines advantages of both close and far loudspeaker positioning namely permits:

- limitation of level/delay modifications due to listener movements of the acoustical paths between the virtual loudspeakers and listener's ears that is typical for far loudspeakers and,
- limitation of the influence of the listening room acoustics which depends on real loudspeakers/listener relative positions that is typical for close loudspeakers.

In other words, there is presented a method and device for reproducing sound from a first input audio signal using a plurality of first loudspeakers and producing a target binaural impression to a listener within a listening area. This obtained by the following steps

- defining a plurality of second virtual loudspeakers positioned outside of the listening area,
- estimating a transfer function between each second virtual loudspeaker and the listener's ears
- computing from the estimated transfer functions transaural filters that modify the said first input audio signal to synthesize second audio input signals;
- synthesizing input signals from second audio input signals for creating a synthesized wave field by the said first loudspeakers that appears, within the listening area, to be emitted by the plurality of second virtual loudspeakers as a plurality of wave fronts in order to reproduce the target binaural impression at the ears of the listener.

According to the invention, the virtual loudspeakers are located outside of the listening area and preferably located at a large distance from the listening area such that the wave fronts they emit are "substantially planar" wave fronts, ideally plane waves, within the entire listening area. The synthesis of a virtual loudspeaker at a given position using a plurality of real loudspeakers may be realized with known physical based sound reproduction techniques such as Wave Field Synthesis (WFS), High Order Ambisonics (HOA), or any kind of beam-forming techniques using loudspeaker arrays. Such techniques enable to synthesize wave fronts in an extended area as if emanating from a virtual loudspeaker at a given position.

None of the above mentioned sound reproduction techniques is actually capable of reproducing an exact plane wave. Substantially planar wave fronts are wave fronts that propagate in the same direction within a given listening area and in a certain frequency band. For example, Wave Field Synthesis is based on the use of horizontal linear regularly spaced loudspeaker arrays. It enables to synthesize "substantially planar" wave fronts in an extended listening area of the horizontal plane below a certain frequency referred to as aliasing frequency. The aliasing frequency depends on several factors such as the spacing of the loudspeakers, the extent of the loudspeaker array and the listening position as described by E. Corteel in "Caractérisation et extensions de la Wave Field Synthesis en conditions réelles", Université Paris 6, PhD thesis, Paris, 2004, available at http://mediatheque.ircam.fr/articles/textes/Corteel04a/.

The main difference between an exact plane wave and a "substantially planar" wave front synthesized by a loudspeaker array is that the latter attenuates during propagation. However, considering Wave Field Synthesis the attenuation may only depend on the distance to the loudspeaker array and not on the direction of propagation of the "substantially planar" wave front. This means that "substantially planar" wave fronts propagating in different directions have similar attenuation characteristics, thus similar levels, at any position within the listening area.

Therefore, the only significant changes of the acoustical paths between the virtual loudspeakers and the listener's ears due to listener's movements compared to a reference listening position are:

- modification of arrival time differences,
- possibly modification of respective levels,
- and modification of the head shadowing depending only on listener's orientation but independent of listener's position.

Therefore, according to the invention, the adaptation of transaural filtering to the listener position within a listening area can be simply achieved in a two-step approach:

- a step of producing wave fronts input signals from an input signal with crosstalk cancellation filters that account only for listener's orientation,
- a step of delaying and attenuating each wave front input signals to account only for listener's position.

The invention therefore enables to extensively simplify the amount of transaural filters to be calculated in order to consider any listener position and listener orientation.

The synthesis of planar wave fronts using a loudspeaker array generally corresponds to increasing the directivity index of the loudspeaker array. It thus enables to limit the interaction of the loudspeaker array with the listening environment and improve the efficiency of crosstalk cancellation. For example, in the case of Wave Field Synthesis, the synthesis of a planar wave front is a special case of beam forming that creates a loudspeaker having an increased directivity in the direction of propagation of the planar wave front. Such results have been published by E. Corteel in "Caractérisation et extensions de la Wave Field Synthesis en conditions réelles", Université Paris 6, PhD thesis, Paris, 2004, available at http://mediatheque.ircam.fr/articles/textes/Corteel04a/.

The invention will be described with more detail hereinafter with the aid of an example and with reference to the attached drawings, in which FIG. 1 is a block diagram that illustrates the general problem, associated with the prior art, of crosstalk cancellation using two loudspeakers.

Figure 1:
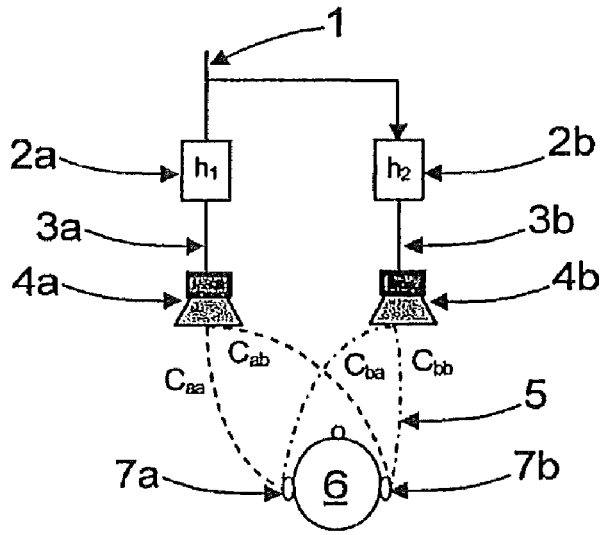
Figure 1 PRIOR ART
Figure 2:
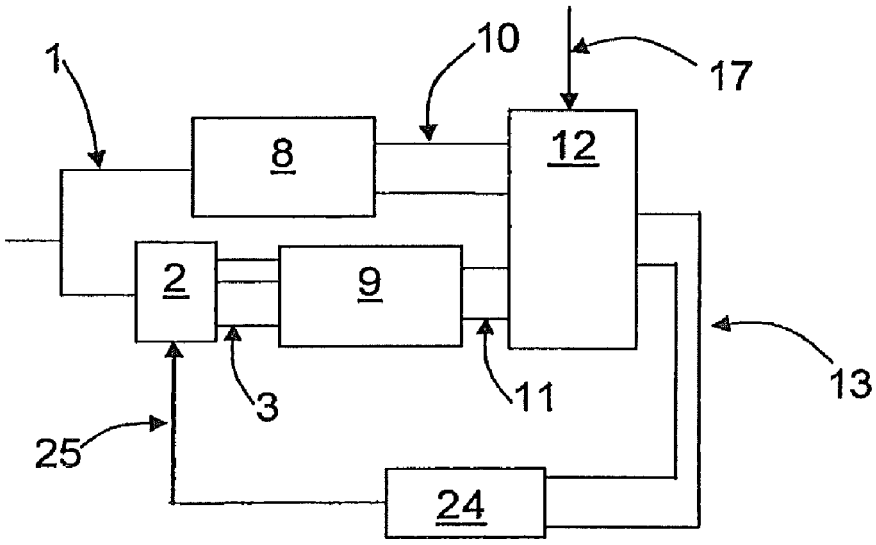
FIG. 2 shows a block diagram for an iterative calculation of the transaural filters.

FIG. 2 shows a block diagram for an iterative calculation of the transaural filters. At time t, desired ear signals 10 are computed from an input signal 1 in a desired signal-processing block 8. The desired ear signals 10 are compared in an error computation block 12 with an estimation of the rendered ear signals 11 for the listener from the loudspeakers. The estimation is realized by, first, processing the input signal 1 with the actual transaural filters 2 to synthesize loudspeakers input signals 3 and, second, processing 9 the loudspeakers input signals 3 with estimated loudspeakers/listener's ears transfer functions 17. Error signals 13 are computed in an error computation block 12 using an appropriate distance function. These error signals 13 drive a filter adaptation unit 24 to modify the transaural filters coefficients 25 in order to minimize the error. An exemplary iterative filter calculation algorithm is described by P. A. Nelson, F. Orduña Bustamente, and H. Hamada in "Multichannel signal processing techniques in the reproduction of sound", *Journal of the Audio Engineering Society,* 44(11), pages 973-989, November 1996.

Figure 3:
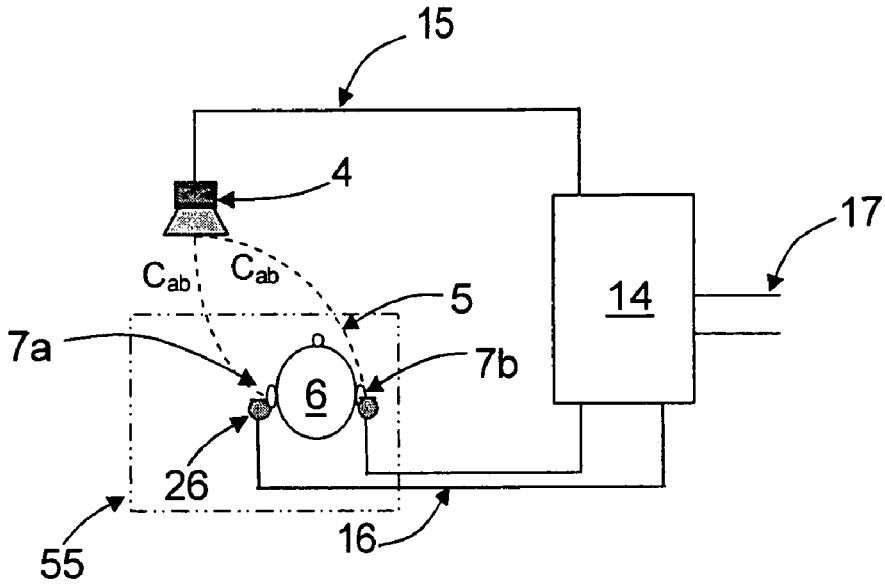
FIG. 3 shows a block diagram that describes loudspeaker/listener ears transfer functions measurements.

FIG. 3 shows a block diagram that describes loudspeaker/listener ears transfer functions measurements. Microphones 26 are positioned in the vicinity or inside the listener's ears 7. A test signal 15 is emitted by a loudspeaker 4. The captured signals 16 by the microphones 26 are processed by the loudspeaker/listener ears transfer functions measurement device 14 and compared to the test signal 15 to extract the loudspeaker/listener ears transfer functions 17. Such measurement technique, for example made in a real environment, can be based on logarithmic sweep test signals as described by A.

Farina in "Simultaneous Measurement of Impulse Response and Distortion with a Swept-Sine Technique", 108th Convention, 2000 Feb. 19-22 Paris, France. The head of the listener, another human being, a dummy head or any shadowing object may be used here for the measurements.

Figure 4:
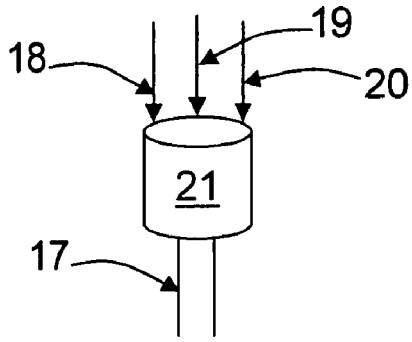
FIG. 4 shows a block diagram that describes the estimation of loudspeaker/listener ears transfer functions from a database of measured HRTFs.

FIG. 4 shows a block diagram that describes the estimation of loudspeaker/listener ears transfer functions from a database of measured HRTFs such as for example, from a publicly available database such as CIPIC database http://interface.cipic.ucdavis.edu/index.htm or the LISTEN database http://recherche.ircam.fr/equipes/salles/listen/. The loudspeaker/listener ears transfer functions 17 can be extracted for each loudspeaker by specifying the loudspeaker position 18 and the listener position 19. The database 21 contains measured transfer functions for an ensemble of relative loudspeaker/listener positions. Interpolation techniques may be used to estimate transfer functions corresponding to relative loudspeaker/listener positions that are not available in the database 21. Such interpolation techniques are described by R. S. Pellegrini in "A virtual listening room as an Application of Virtual Auditory Environment", Ph. D. thesis, Ruhr-universität, Bochum, Germany. The head of the listener, another human being, a dummy head or any shadowing object may be used here for the measurements.

Figure 5:
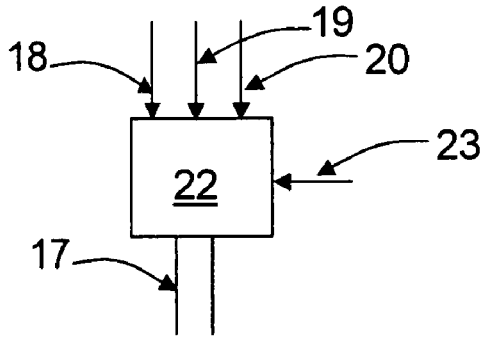
FIG. 5 shows a block diagram that describes the estimation of loudspeaker/listener ears transfer functions from a physically based model.

FIG. 5 shows a block diagram that describes the estimation of loudspeaker/listener ears transfer functions from a physically based model 22. The loudspeaker/listener ears transfer functions 17 can be estimated using a physically based model that describes the sound scattering on a human head or any similar object such as a sphere. Such model requires information on the loudspeaker position 18 and the listener position 19 and head orientation 20. Additional physical model parameters 23 are required. For example, these parameters 23 can account for: the size of the head, the position of the ears, or the precise shape of the head. An example of such model is described by V. Ralph, Algazi and Richard O. Duda, Ramani Duraiswami, Nail A. Gumerov, and Zhihui Tang in "Approximating the head-related transfer function using simple geometric models of the head and torso", The Journal of the Acoustical Society of America, November 2002, Volume 112, Issue 5, pp. 2053-2064. The head of the listener, another human being, a dummy head or any shadowing object may be considered in the model.

Figure 6:
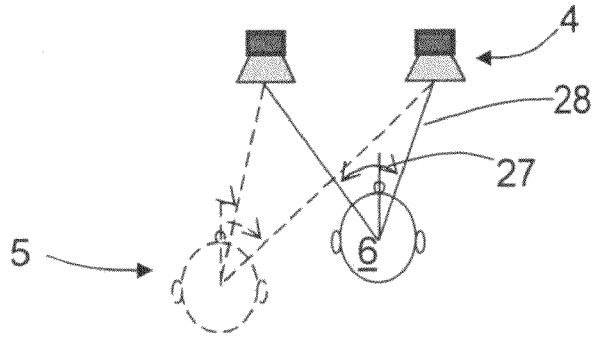
FIG. 6 shows the influence of listener's movements to loudspeakers/listener head relative positions in the case of close by loudspeakers.

FIG. 6 shows the influence of listener's movements to loudspeakers/listener head 6 relative positions in the case of close by loudspeakers. These modify the loudspeakers/listener ear acoustical paths 5 from each loudspeaker 4 to the head 6 of the listener. The distance 28 of the listener relative to the loudspeakers changes. This implies both level and propagation time modifications in the corresponding acoustical path. Additionally, the visibility angles 27 of the loudspeakers towards the listener's head changes. This means that the shadowing effect of the head is also modified.

Figure 7:
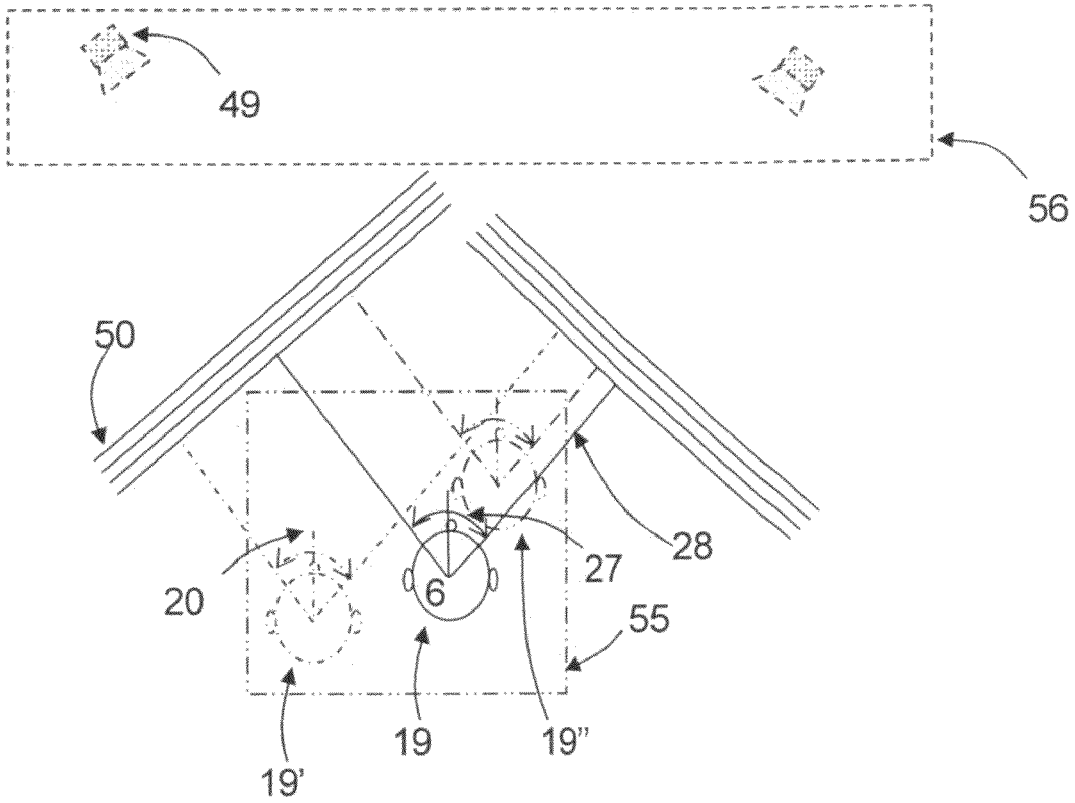
FIG. 7 shows the influence of listener's movements within the listening area on loudspeakers/listener ear acoustical paths considering substantially planar wave fronts as if emitted by virtual loudspeakers at large distances from the listening area.

FIG. 7 shows the influence of listener's movements within a listening area 55 on loudspeakers/listener ear acoustical paths considering substantially planar wave fronts 50 as if emitted by virtual loudspeakers 49 at large distances from the listening area 55. Virtual loudspeakers 49 are located in a virtual loudspeaker positioning area 56 which does not intersect with the listening area 55. In this case, only the arrival time of wave fronts 50 for different listening positions changes. The visibility angles 27 of the loudspeakers towards the listener's head remains the same at any listener position 19, 19', 19" for a given listener head orientation 20.

Figure 8:
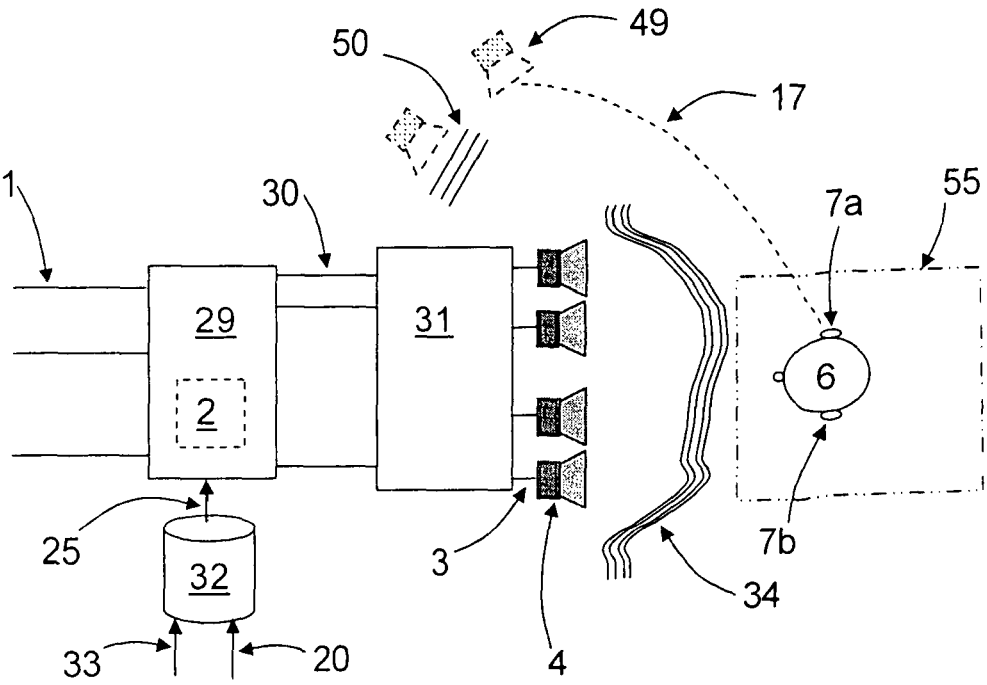
FIG. 8 shows a block diagram of a device according to the present invention.
Figure 10:
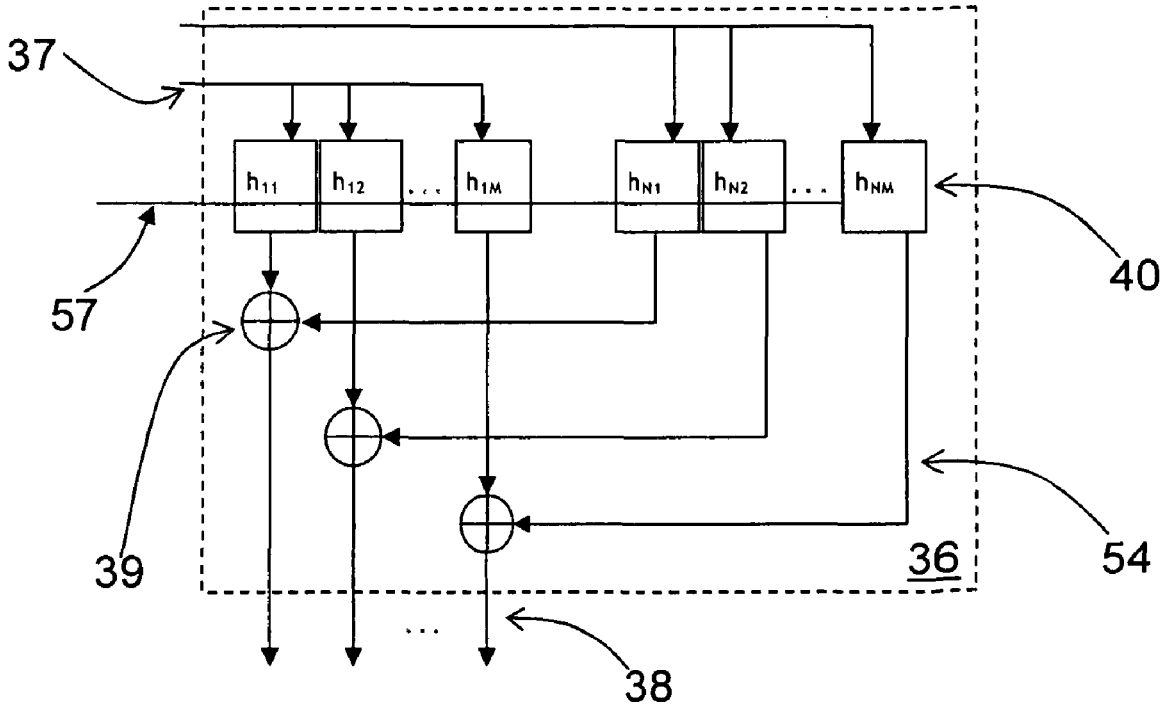
FIG. 10 shows a block diagram of a general matrix filtering device.

FIG. 8 shows a block diagram of a device according to the present invention. In this device, a plurality of input signals 1 feed a transaural filtering computation device 29 that synthesizes virtual loudspeakers input signals 30. The transaural filtering computation device 29 may be realized as a matrix filtering device 36 as shown in FIG. 10. The associated filter coefficients 25 are extracted from a database 32 of transaural filters using binaural impression description data 33 associated to each input signal 1 and data defining listener's head orientation 20. The extracted filter coefficients 25 are calculated from the virtual loudspeakers/listener's ears transfer function 17 corresponding to the listener's head orientation 20 in order to produce the target binaural impression for the listener 6. The virtual loudspeakers input signals 30 feed a virtual loudspeaker synthesis device 31 to synthesize loudspeakers input signals 3 for real loudspeakers 4 in order to synthesize a wave field 34 composed of a plurality of "substantially" planar wave fronts 50 as if emitted by virtual loudspeakers 49 at large distance from the listening area 55.

In an exemplary form of this device, the loudspeakers may be arranged in a linear array. The wave front computation device 31 may be realized as a matrix filtering device 36 (FIG. 10). The filters that enable the synthesis of the virtual loudspeakers 49 may be defined using Wave Field Synthesis in order to synthesize far point sources or plane waves as described by E. Corteel in "Adaptations de la Wave Field Synthesis aux conditions réelles", Université Paris 6, PhD thesis, Paris, 2004. According to this exemplary form of the invention, the virtual loudspeakers 49 are therefore defined by the position and the radiation characteristics of the sources synthesized using Wave Field Synthesis.

Figure 9:
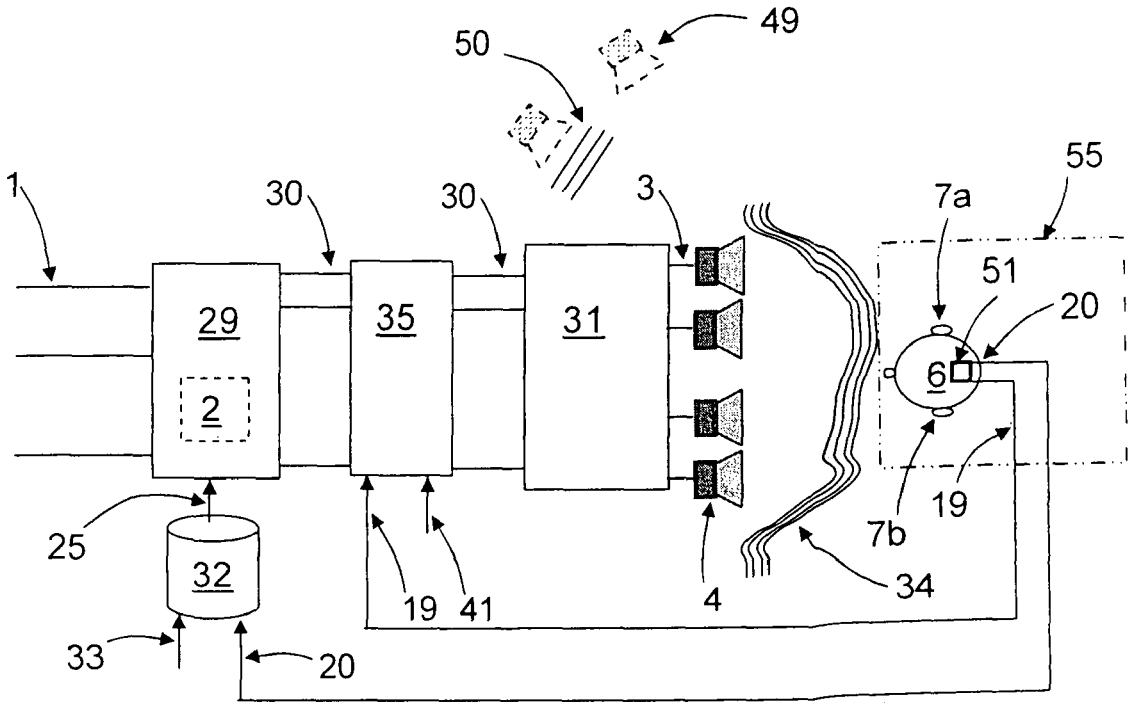
FIG. 9 shows a block diagram of a device reactive to tracking of the listener's head position/orientation according to the present invention.

FIG. 9 shows a block diagram of a device reactive to tracking of the listener's head position/orientation according to the present invention. In this device, a listener tracking device 51 is providing information about the listener's head position 19 and/or orientation 20. A plurality of input signals 1 feed a transaural filtering computation device 29 that synthesizes virtual loudspeakers input signals 30. The transaural filtering computation device 29 may be realized as a matrix filtering device 36. The associated filter coefficients 25 are extracted from a database of transaural filters 32 using, for each of the input signals 1, the specified binaural impression description data 33 as stored in the database 32 and the actual orientation of the head of the listener 20. The virtual loudspeakers input signals 30 feed a listener position compensation device 35 that modify the virtual loudspeakers input signals 30 according to the actual listener position 19 and virtual loudspeakers description data 41. The modified virtual loudspeakers input signals 30 feed a wave front computation device 31 to synthesize loudspeakers input signals 3 in order to synthesize a wave field composed of a plurality of "substantially" planar wave fronts 50 (FIG. 7) as if emitted by virtual loudspeakers 49 at large distance from the listening area 55.

In an exemplary form of this device, the loudspeakers may be arranged in a linear array. The wave front computation device 31 may be realized as a matrix filtering device 36 (FIG. 10). The wave front computation filters may be defined using Wave Field Synthesis in order to synthesize far point sources or plane waves as described by E. Corteel in "Adaptations de la Wave Field Synthesis aux conditions réelles", Université Paris 6, PhD thesis, Paris, 2004. The tracking can be realized using such device as described in U.S. patent application Ser. No. 2005226437.

FIG. 10 shows a block diagram of a general matrix filtering device 36. A plurality of input signals 37 are processed by a set of filtering devices 40 to synthesize output signals 54 associated to each input signal 37. Such input signals 37 may correspond to input signals 1 in FIG. 8 and 9. Then, a step of summing in summing units 39 is performed on the respective output signals 54 for each output to derive the plurality of matrix filtering output signals 38. Such output signals 38 may be used to feed loudspeakers 4. The filtering devices are also fed with required matrix filtering coefficients 57. They may also provide interpolation means to smoothly update the filter as described by R. S. Pellegrini in "A virtual listening room as an Application of Virtual Auditory Environment", Ph. D. thesis, Ruhr-universität, Bochum, Germany. Such matrix filtering device 36 may be used to realize the transaural filtering device 29 or the wave front computation device 31.

Figure 11:
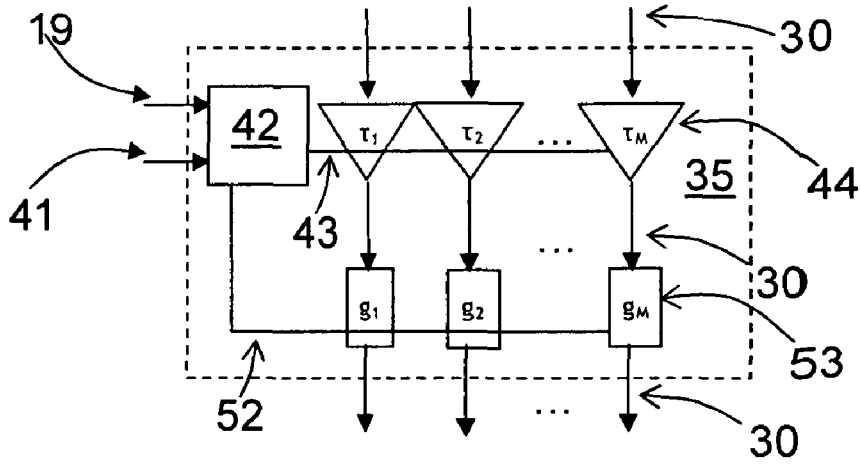
FIG. 11 shows a block diagram of a listener position compensation device.

FIG. 11 shows a block diagram of a listener position compensation device 35. Delaying 44 and attenuating 53 devices are used to modify the virtual loudspeaker input signals 30. Listener position compensation gains 52 and delays 43 are computed in a listener position compensation computation device 42 from listener position 19 and virtual loudspeakers description data 41. The virtual loudspeakers description data 41 may correspond to virtual loudspeakers' position.

Figure 12:
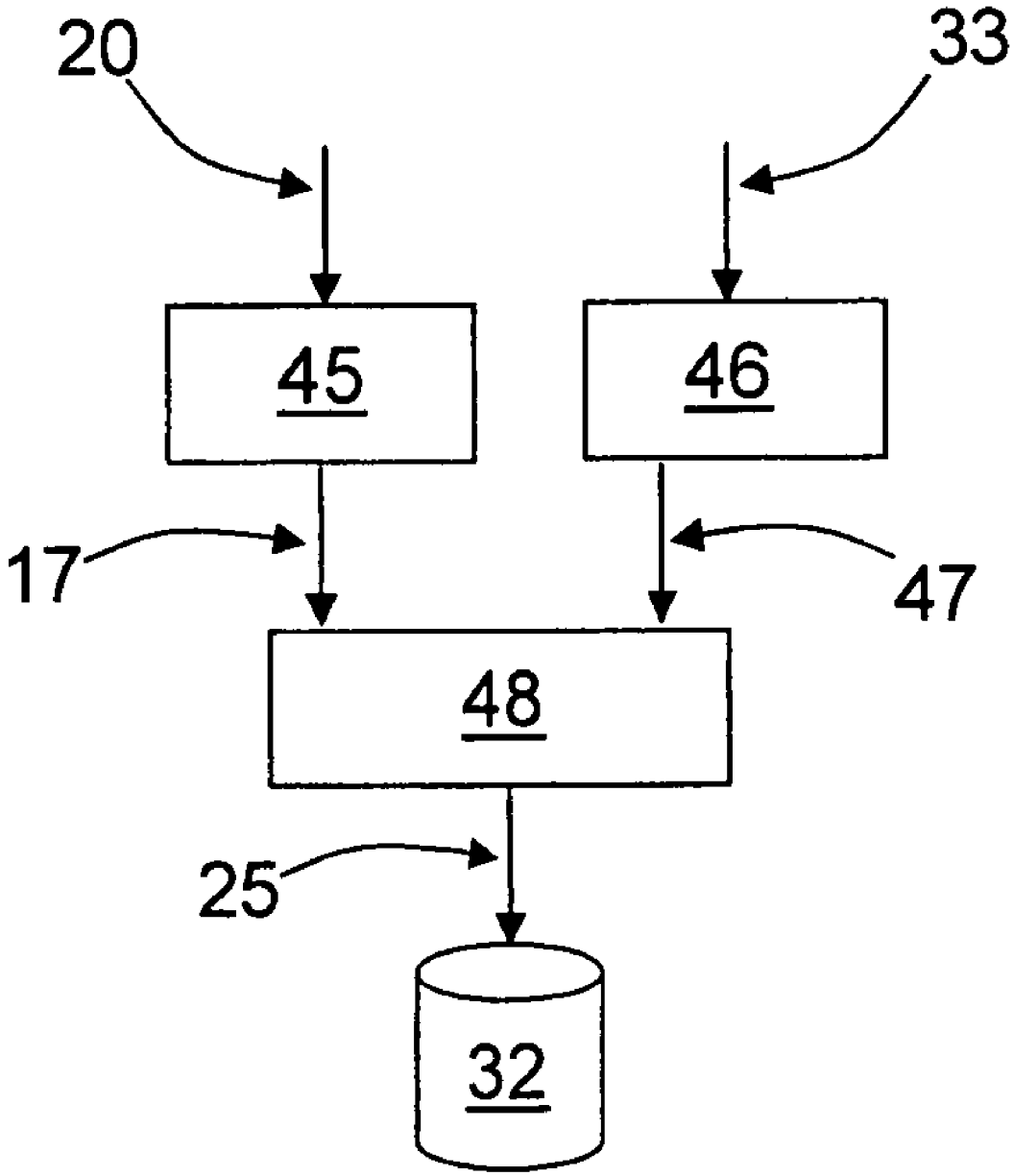
FIG. 12 shows a block diagram of the method to derive transaural filters according to the present invention.

FIG. 12 shows a block diagram of the method to derive transaural filters according to the present invention. The virtual loudspeakers/listener ears transfer functions 17 are derived in a virtual loudspeakers/listener ears transfer function estimation device 45 that is fed by data defining the listener's head orientation 20. The desired listener ear signals estimation device 46 outputs desired listener ear signals 47 from the binaural impression description data 33. Both virtual loudspeakers/listener ears transfer functions 17 and desired listener ear signals 47 feed a transaural filters computation device 48 which outputs transaural filter coefficients 25. The transaural filter coefficients are stored in a database 32 for the given listener's head orientation 20 and binaural impression description 33. The binaural impression description data 33 may correspond to level and time separation, eventually in frequency bands, of the signals at listener's ears 7. In the case of crosstalk cancellation, the level separation may therefore be infinite between both ears. The binaural impression description data 33 may also correspond to the position of a virtual sound source to be synthesized by targeting appropriate HRTFs at the listener's ears 7. They could correspond to a degree of correlation of binaural signals which can be related to attributes of spatial impression as described by J. Blauert in "Spatial Hearing, the psychophysics of human sound interaction", MIT Press, 1999.

| | |
|---|---|
| 1 | input signal |
| 2 | transaural filtering |
| 3 | loudspeaker input signals |
| 4 | loudspeakers |
| 5 | loudspeaker/listener's ear acoustical paths |
| 6 | listener's head |
| 7 | listener's ears |
| 8 | desired signal processing |
| 9 | estimation/processing of captured signals at listener's ears from the synthesized wave field emitted by loudspeakers |
| 10 | desired signals at listener's ears |
| 11 | rendered ear signals for the listener from the loudspeakers |
| 12 | in an error computation block |
| 13 | error signals |
| 14 | loudspeaker/listener ear transfer functions measurement device |
| 15 | measurement test input signal |
| 16 | measurement signals at listener's ears |
| 17 | loudspeaker/listener ear transfer functions |
| 18 | loudspeaker position |
| 19 | listener position |
| 20 | listener orientation |
| 21 | database of measured HRTFs |
| 22 | loudspeaker/listener ear transfer functions estimation physical model |
| 23 | loudspeaker/listener ear transfer functions estimation physical model parameters (size of the head, position of the ears, precise shape of the head, . . .) |

-continued

| | |
|---|---|
| 24 | filter adaptation unit |
| 25 | filter coefficients |
| 26 | microphone |
| 27 | visibility angle of a loudspeaker toward listener's head position/orientation |
| 28 | distance of a loudspeaker to listener's head center |
| 29 | transaural filtering computation device |
| 30 | virtual loudspeakers input signals |
| 31 | virtual loudspeaker synthesis device |
| 32 | transaural filter database |
| 33 | binaural impression description data |
| 34 | synthesized wave field |
| 35 | listener position compensation device |
| 36 | matrix filtering device |
| 37 | matrix filtering input signals |
| 38 | matrix filtering output signals |
| 39 | summation device |
| 40 | filtering device |
| 41 | virtual loudspeakers description data |
| 42 | listener position compensation computation device |
| 43 | listener position compensation delays |
| 44 | delaying device |
| 45 | virtual loudspeakers/listener ears transfer functions estimation device |
| 46 | desired listener ear signals estimation device |
| 47 | desired listener ear signals |
| 48 | transaural filters calculation device |
| 49 | virtual loudspeakers situated outside of the listening area |
| 50 | wave fronts "emitted" by virtual loudspeakers |
| 51 | listener tracking device |
| 52 | listener position compensation gains |
| 53 | attenuating device |
| 54 | matrix filtering output signals associated to each input signal |
| 55 | listening area |
| 56 | virtual loudspeaker positioning area |
| 57 | matrix filtering coefficients |

The invention claimed is:

1. A method for reproducing sound from a first input audio signal using a plurality of first loudspeakers and producing a target binaural impression to a listener within a listening area, the method comprising:

defining a plurality of second virtual loudspeakers positioned outside of the listening area;

estimating a transfer function between each second virtual loudspeaker and the listener's ears;

computing from the estimated transfer functions transaural filters that modify the first input audio signal to synthesize second audio input signals; and synthesizing input signals from second audio input signals for creating a synthesized wave field by the first loudspeakers that appears, within the listening area, to be emitted by the plurality of second virtual loudspeakers as a plurality of wave fronts in order to reproduce the target binaural impression at the ears of the listener.

2. The method of claim 1, wherein the transfer functions between each virtual loudspeaker and the listener's ears are estimated considering an ensemble of orientations and/or positions of the listener's head.

3. The method of claim 1, wherein the transfer functions between each virtual loudspeaker and the listener's ears are estimated using measurements in the real environment.

4. The method of claim 1, wherein the transfer functions between each virtual loudspeaker and the listener's ears are estimated from head related transfer function measurements or a model of the head of the listener, another human being, a dummy head or any shadowing object.

5. The method of claim 2, wherein the transaural filters are computed for the ensemble of head orientations and an ensemble of target binaural impression data, and are stored in a database.

6. The method of claim 1, wherein the transaural filters are computed in order to synthesize the desired binaural impression data in a limited frequency band.

7. A sound reproduction device for producing a target binaural impression to a listener from a plurality of input signals using a plurality of first loudspeakers comprising:

a transfer function estimation device for deriving an estimated transfer function between each of a plurality of defined second virtual loudspeakers and the listener's ears;

a transaural filtering computation device for filtering each input signal with transaural filters, computed from the estimated transfer functions, in order to synthesize second audio input signals; and a virtual loudspeaker synthesis device for synthesizing input signals for the plurality of first loudspeakers from second input signals for creating a synthesized wave field that appears, within the listening area, as a plurality of wave fronts emitted by the plurality of second virtual loudspeakers located outside of the listening area.

8. The device of claim 7, wherein a database is connected to the transaural filtering computation device and fed with listener's head orientation data and target binaural impression data.

9. The device of claim 8, wherein tracking means are provided for estimating the orientation of the listener's head.

10. The device of claim 7, wherein a listener position compensation device is used to delay and attenuate the second audio input signals in order to synchronize the arrival time and level of the wave fronts according to the listener's position estimated with tracking means.

* * * * *